US011800934B2

(12) United States Patent
Grathwol

(10) Patent No.: US 11,800,934 B2
(45) Date of Patent: Oct. 31, 2023

(54) PIECE OF FURNITURE AND METHOD FOR ASSEMBLING A PIECE OF FURNITURE

(71) Applicant: Hettich Franke GmbH & Co. KG, Balingen-Weilstetten (DE)

(72) Inventor: Steffen Grathwol, Balingen (DE)

(73) Assignee: HETTICH FRANKE GMBH & CO. KG, Balingen-Weilstetten (DE)

( * ) Notice: Subject to any disclaimer, the term of this patent is extended or adjusted under 35 U.S.C. 154(b) by 104 days.

(21) Appl. No.: 17/627,140

(22) PCT Filed: Jul. 1, 2020

(86) PCT No.: PCT/EP2020/068443
§ 371 (c)(1),
(2) Date: Jan. 14, 2022

(87) PCT Pub. No.: WO2021/008869
PCT Pub. Date: Jan. 21, 2021

(65) Prior Publication Data

US 2022/0248857 A1 Aug. 11, 2022

(30) Foreign Application Priority Data

Jul. 16, 2019 (DE) ..... 10 2019 119 307.9

(51) Int. Cl.
*A47C 1/027* (2006.01)
*A47C 1/03* (2006.01)
(Continued)

(52) U.S. Cl.
CPC ..... *A47C 7/5066* (2018.08); *A47C 1/027* (2013.01); *A47C 1/03* (2013.01); *A47C 1/0308* (2018.08);
(Continued)

(58) Field of Classification Search
CPC ..... A47C 1/027; A47C 7/38; A47C 7/506; A47C 1/03; A47C 1/0308; A47C 7/48; A47C 7/541; A47C 7/5066
(Continued)

(56) References Cited

U.S. PATENT DOCUMENTS 3,779,655 A * 12/1973 Toyota ..... A47C 1/026 403/93
5,375,914 A 12/1994 Donnelly
(Continued)

FOREIGN PATENT DOCUMENTS

DE 20005850 U1 7/2000
DE 102005057525 B3 6/2007
(Continued)

OTHER PUBLICATIONS

International Search Report dated Oct. 8, 2020 issued in PCT/EP2020/068443 (with English translation).
(Continued)

*Primary Examiner* — Rodney B White
(74) *Attorney, Agent, or Firm* — Collard & Roe, P.C.

(57) ABSTRACT

A piece of furniture, in particular a piece of seating furniture, has a base part on which a movable furniture part is pivotably mounted via at least one pivot fitting, wherein the at least one pivot fitting is fixed to the base part by means of a first lever and is fixed to the movable furniture part by means of a second lever which is arranged pivotably with respect to the first lever, and a method for assembling a piece of furniture.

11 Claims, 6 Drawing Sheets

(51) Int. Cl.
*A47C 7/48* (2006.01)
*A47C 7/50* (2006.01)
*A47C 7/54* (2006.01)
*A47C 7/38* (2006.01)

(52) U.S. Cl.
CPC ..... *A47C 7/38* (2013.01); *A47C 7/48* (2013.01); *A47C 7/541* (2018.08)

(58) Field of Classification Search
USPC ..... 297/374, 375, 376, 354.11, 411.32, 297/411.37, 411.38, 423.26, 423.29, 297/423.3
See application file for complete search history.

(56) References Cited

U.S. PATENT DOCUMENTS

| | | | | |
|---|---|---|---|---|
| 8,104,141 | B2 * | 1/2012 | Yamashita | A47C 1/026 16/334 |
| 8,156,612 | B2 * | 4/2012 | Yamashita | A47C 1/026 403/93 |
| 9,211,011 | B2 * | 12/2015 | Hashida | A47C 1/026 |
| 9,399,421 | B2 * | 7/2016 | Lu | B60N 2/853 |
| 9,790,985 | B2 * | 10/2017 | Haug | A47C 1/026 |
| 9,861,207 | B2 * | 1/2018 | DeFranks | A47C 27/065 |
| 10,398,236 | B2 * | 9/2019 | Achten | B33Y 10/00 |
| 10,993,535 | B2 * | 5/2021 | Nill | A47C 1/0308 |
| 11,209,042 | B2 * | 12/2021 | Nill | F16C 11/04 |
| 11,272,787 | B2 * | 3/2022 | Nill | A47C 1/026 |
| 11,324,323 | B2 * | 5/2022 | Deevers | A47C 7/029 |
| 2009/0309403 | A1 * | 12/2009 | Mackert | A47C 7/38 297/354.13 |
| 2013/0011181 | A1 * | 1/2013 | Riedmueller | A47C 7/5066 403/84 |
| 2017/0367483 | A1 * | 12/2017 | Fecker | A47C 7/52 |
| 2018/0071979 | A1 * | 3/2018 | Achten | B33Y 10/00 |
| 2021/0007488 | A1 | 1/2021 | Nill | |
| 2022/0225770 | A1 * | 7/2022 | Grathwol | A47C 1/031 |
| 2022/0240680 | A1 * | 8/2022 | Deevers | A47C 7/16 |
| 2022/0395109 | A1 * | 12/2022 | Prince, Jr. | B33Y 80/00 |

FOREIGN PATENT DOCUMENTS

| | | | | |
|---|---|---|---|---|
| DE | 202008001323 | U1 | 4/2008 | |
| DE | 102009007899 | A1 | 8/2009 | |
| DE | 202010000368 | U1 * | 9/2011 | A47C 1/026 |
| DE | 102015113749 | A1 | 2/2017 | |
| DE | 202017101471 | U1 * | 5/2017 | A47C 7/38 |
| DE | 102017110248 | A1 * | 11/2018 | A47C 20/023 |
| DE | 102017110253 | A1 | 11/2018 | |
| EP | 2526828 | A1 * | 11/2012 | A47C 1/026 |
| EP | 2532275 | A1 | 12/2012 | |
| EP | 3400835 | A1 * | 11/2018 | A47C 1/026 |
| EP | 3865009 | A1 * | 8/2021 | A47C 7/5066 |
| EP | 3871563 | A1 * | 9/2021 | A47C 1/0308 |
| FR | 3065500 | A3 * | 10/2018 | A47C 1/025 |
| WO | WO-2021008869 | A1 * | 1/2021 | A47C 5/12 |

OTHER PUBLICATIONS

German Search Report dated Apr. 27, 2021 issued in the corresponding German Application Serial No. 10 2019 119 307.9 (with English translation of relevant parts).

* cited by examiner

PIECE OF FURNITURE AND METHOD FOR ASSEMBLING A PIECE OF FURNITURE

CROSS REFERENCE TO RELATED APPLICATIONS

This application is the National Stage of PCT/EP2020/068443 filed on Jul. 1, 2020, which claims priority under 35 U.S.C. § 119 of German Application No. 10 2019 119 307.9 filed on Jul. 16, 2019, the disclosures of which are incorporated by reference. The international application under PCT article 21(2) was not published in English.

BACKGROUND OF THE INVENTION

The present invention relates to a piece of furniture, in particular a piece of seating furniture, comprising a base part on which a movable furniture part s pivotably mounted via at least one pivot fitting, wherein the at least one pivot fitting is fixed to the base part by means of a first lever and is fixed to the movable furniture part by means of a second lever which is arranged pivotably with respect to the first lever, and a method for assembling a piece of furniture.

DE 10 2015 113 749 A1 discloses a pivot fitting for a piece of upholstered furniture, in which two levers are mounted so as to be rotatable relative to one another, wherein the two levers are able to be continuously fixed in different angular positions relative to one another by means of a clamping mechanism. This enables flexible use of the pivot fitting for armrests, foot sections, side rests or other movable furniture parts.

Another pivot fitting is shown in DE 10 2017 110 253 A1, which also comprises two levers that are rotatable relative to each other and can be fixed in different angular positions by means of a clamping mechanism for fixing the levers. The clamping mechanism comprises at least one pawl and a pinion. In such pivoting fittings, the levers are connected to each other on the movable furniture part via a panel, for example a wooden board, and then surrounded by upholstery foam arranged under a cover. The manufacture of such upholstered movable furniture parts thereby requires many working steps, and the use of different materials is disadvantageous with regard to subsequent disposal.

Movable furniture parts according to the known prior art mostly consist of a wooden board as a carrier element of foams, a layer of wadding and cover fabrics. The pivot fittings are then screwed to these wooden boards by means of screws on the drive-in nuts previously inserted in the wooden board. On the one hand, this known structure is inflexible with regard to the design of the furniture part and, on the other hand, it requires very complex manufacturing steps such as the gluing on of foams.

SUMMARY OF THE INVENTION

Therefore, it is an object of the present invention to provide a piece of furniture having a pivot fitting in which the movable piece of furniture can be effectively assembled. Furthermore, an optimized method for assembling a piece of furniture is to be provided.

A further object is to make the structure and manufacture of a furniture part simpler, more flexible and suitable for simplified assembly.

This object is solved with a piece of furniture having the features of claim 1 and a method having the features of claim 17.

In the piece of furniture according to the invention, the second lever of the pivot fitting is fixed to a molded body which is provided with a plurality of hollow chambers, which molded body forms a core of the movable furniture part. This molded body is pivotably mounted on one or more pivot fittings and can have different shapes, depending on the application, wherein a low dead weight is present due to the provision of hollow chambers. This eliminates the need to build up the core of the movable furniture part from a plurality of different materials which have to be joined together. The molded body may be made of a single material, in particular plastic, wherein fillers may also be added to the plastic, such as lignocellulosic fibers, recycled fibers made of plastic or cotton, or powdery substances.

Preferably, a pocket is formed in the molded body for accommodating at least a part of the second lever. The second lever can then be partially or completely inserted into the pocket and is preferably fixed there in a damping or latching manner. In this way, the molded body can be mounted on the second lever without tools. For this purpose, corresponding clamping contours, such as a wedge-shaped clamping contour, or a bendable latching web with a projection, which engages in a recess on the lever, may be formed on the pocket. The connection can be designed either non-releasable or also releasable, for example in that the bendable latching web is lifted out of the positive engagement again by a release lever.

The molded body preferably has a stiffening structure formed from webs, wherein the webs surround the hollow chambers. The molded body can be manufactured integrally or assembled from several individual parts. Assembling from individual parts has the advantage that the molded body can be assembled in different lengths or widths, depending on the application. Advantageously, the molded body can have regions with a higher web density and regions with a lower web density. In particular, in the regions designed as a support surface for the head, arms or legs, a lower web density can provide a greater springiness of the molded body, which increases the support comfort. Whereas, in the areas where the pockets are arranged for accommodating at least a part of the second lever, a higher web density is very advantageous for stiffening.

In a further design, a slot is formed on the molded body through which the first lever is passed. The slot may extend along a rounded edge of the molded body over a predetermined angular range to allow the molded body to pivot relative to the first lever.

Preferably, the molded body has a smooth surface on two opposite sides. This surface may serve as a support, wherein preferably a different elasticity is present at the surfaces due to the shaping of the molded body, One surface may be more elastically formed, i.e. it may deform more elastically than the other surface when a predetermined contact pressure is applied. This can determine which surface is used as a support surface and which surface is used as an elastic surface. This can be carded out by adjusting the stiffening structure, which results in a higher stiffness on one side than on the opposite side.

The molded body or its individual parts are preferably produced by injection molding, extrusion or 3D printing. In this case, the proportion of hollow chambers in the molded body in relation to the total volume can be more than 50%, for example between 60% and 95%, As a result, the molded body can have a relatively low dead weight and already form the geometry that the movable furniture part is to approximately assume. The molded body can thereby directly form the movable furniture part, i.e. be accessible from the outside. Preferably, however, a flexible cover is applied around the molded body. Such a flexible cover may, for example, be a cover of leather, a textile material or an elastic plastic, which forms the outer surface of the movable furniture part. In this context, a further component may optionally be fixed to the molded body, such as a display with a screen, an operating unit and/or a control unit, for example if a medium or an application is to be integrated into the movable furniture part. For this purpose, a corresponding receptacle may be formed on the molded body.

The movable furniture part can be pivotabiy mounted on the base part via two or more pivot fittings. In this respect, the movable furniture part may be formed as an armrest, a foot part or a headrest. For example, the base part may be a seat of an upholstered furniture or a vehicle seat. Furthermore, the base part can also be a treatment chair on which a movable furniture part is pivotably mounted.

Preferably, the molded body may have a low net weight without the pivot fitting, for example of less than 350 g, in particular between 50 g and 250 g.

The molded body can be used with the pivot fitting for various applications, in particular also in vehicles. The term "furniture" should therefore not be understood restrictively, but also comprise shelves, armrests or other movable components which are installed in vehicles or ships or aircraft.

In the method according to the invention, a base part is provided to which a first lever of a pivot fitting is fixed, A second lever of the pivot fitting is inserted into a molded body which has a plurality of hollow chambers and is produced by injection molding, extrusion or 3D printing. This simplifies the assembly of the molded body, as it is merely plugged onto one or more levers. The molded body can then optionally be surrounded by a flexible cover to finish the furniture.

In the design according to the invention, different types of pivot fittings may be used. In addition to pivot fittings in which the first lever and the second lever are adjusted relative to one another about an axis of rotation by means of a clamping mechanism, other pivot fittings can also be used, for example, which, in addition to the pivoting movement, allow translatory movements of the second lever relative to the first lever, as is the case, for example, in DE 20005850U or DE202008001323U1. Then, the second lever can also be designed as a lever that can be moved translationally with respect to the pivoting fitting or as an angle piece, in these cases, the pivoting is performed by means of a rotation or a combination of rotation and translation.

Within the scope of the invention, it is also possible to use pivoting fittings in which pivoting is effected by means of a different mechanical principle, such as that of a four-bar linkage or a multi-bar mechanism.

Independently of the solution indicated in calm 1, the invention may also relate to a piece of furniture, in particular a piece of seating furniture, comprising a base part and at least one furniture part connected to the base part by means of a moving fitting or a connecting fitting, wherein the furniture part comprises a molded body provided with a plurality of hollow chambers and forming a core of the piece of furniture. The molded body may be formed according to the exemplary embodiment shown below, but without the pivot fitting. The moving fitting may be formed as a linear guide, a pull-out guide or a sliding fitting. Thus, the molded body can also be used for sliding headrests or other furniture parts. The present invention can also be used for rigid furniture parts, so that the melded body is fixed only by a connecting fitting, for example in a fixed back part. Then, for example, the straps which are stapled to the back parts could be omitted. Furthermore, the foam and the wadding would also be omitted here.

Another exemplary embodiment would also be the use of the invention in a seat part of a piece of furniture. In this case, the furniture part with the molded body can be screwed to a carcass or plugged onto the carcass.

The invention is explained in more detail below with reference to the accompanying drawings by way of an exemplary embodiment, wherein:

BRIEF DESCRIPTION OF THE DRAWING FIGURES

DETAILED DESCRIPTION OF THE INVENTION

Figure 1:
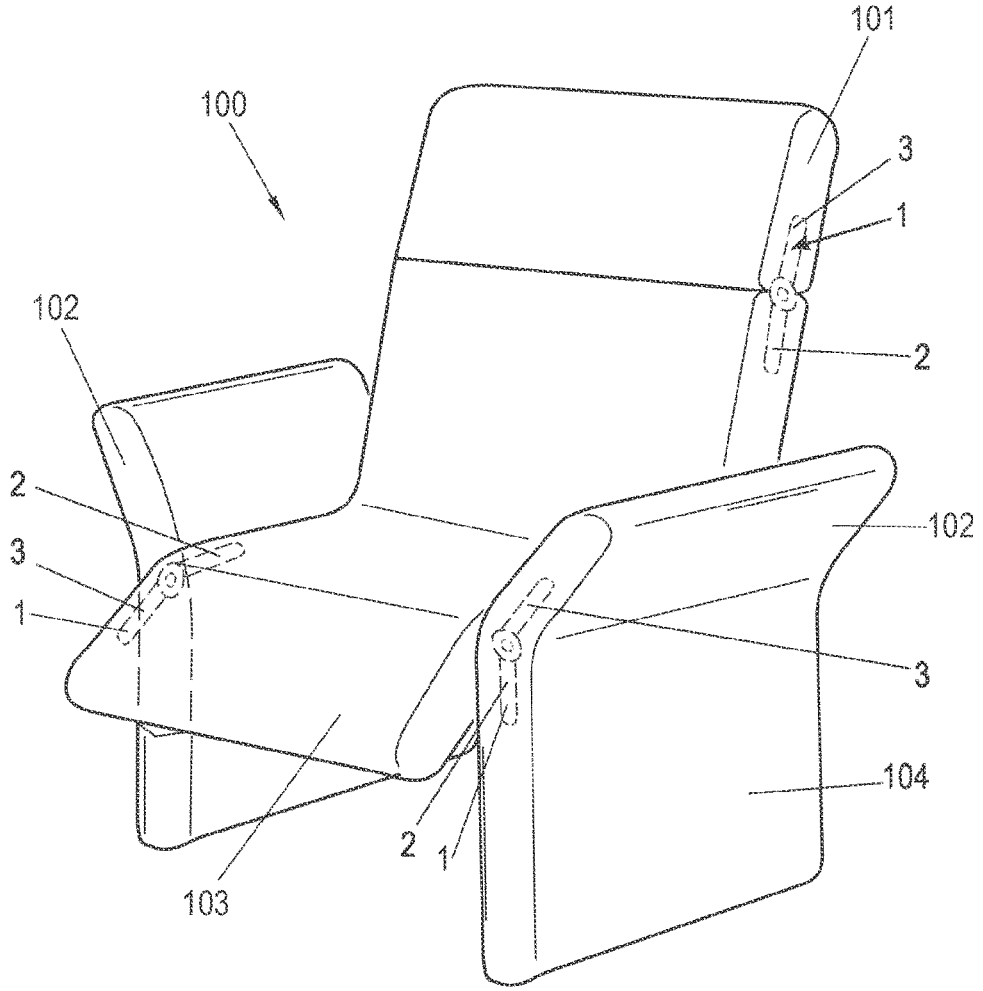
FIG. 1 shows a perspective view of a piece of furniture according to the invention.

A piece of furniture 100 is designed as a piece of seating furniture and comprises a base part 104, which has a seating surface and a frame for supporting or fastening the base part 104. The schematically illustrated piece of furniture 100 has a movable furniture part 101, which is formed as a pivotable head part and is connected to a backrest of the base part 104 via one or more pivot fittings 1. Furthermore, a movable furniture part 102 is provided on opposite sides as a side part, which is also connected to a frame of the base part 104 via one or more pivot fittings 1. A further movable furniture part 103 is formed as a foot part and is connected to the base part 104 via one or more pivot fittings 1. In this respect, a first lever 2 of a pivot fitting 1 is fixed to the base part 104 in all movable furniture parts 101, 102 and 103, while a second lever 3, which is pivotally mounted on the first lever 2 and an be fixed in different angular positions, is fixed in each case to the movable furniture part 101, 102 or 103. The piece of furniture 100 can be designed as upholstered furniture, such as an armchair, sofa, bed, but also as a vehicle or aircraft seat or as a treatment chair. In particular, the movable furniture parts can also be used in mobile homes, ships or other vehicles.

Figure 2:
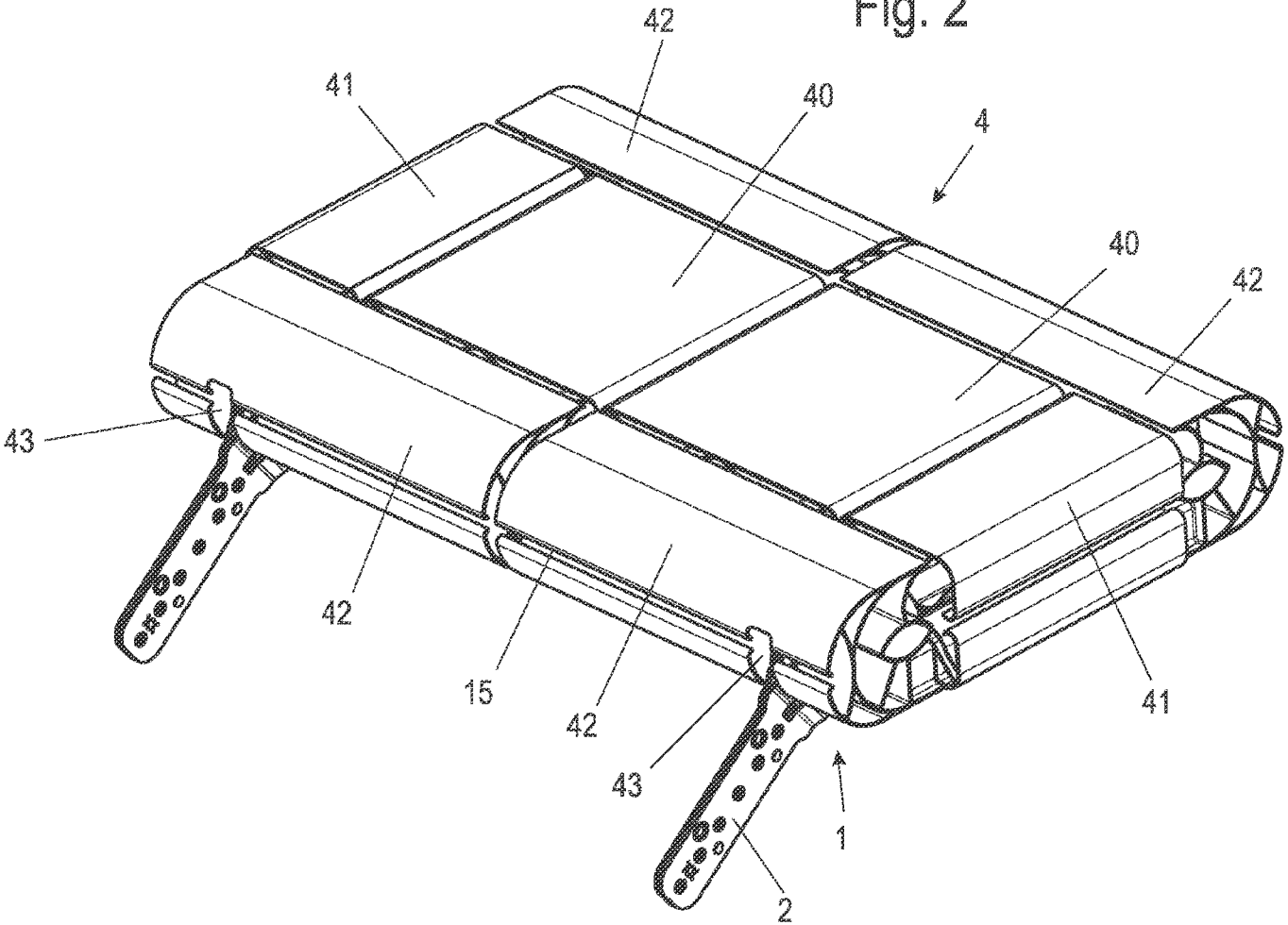
FIG. 2 shows a perspective view of the movable furniture part with two pivot fittings.

In FIG. 2, a molded body 4 is shown which forms a core of a movable furniture part 101, 102 or 103 and is connected to the base part 104 via two pivot fittings. The molded body 4 comprises a plurality of individual parts 40, 41 and 42 which are assembled to form a unit. The individual parts 40, 41 and 42 may be inserted into one another, fixed to one another by fastening means or glued to one another.

A slot 43 is formed on the molded body 4 in the region of the pivot fitting 1, and the first lever 2 of the pivot fitting 1 is passed through the slot 43. When the molded body 4 is adjusted by rotating the pivot fitting 1, the molded body 4 pivots relative to the first lever 2, and the slot 43 is correspondingly recessed by a certain angular section in the molded body 4.

Figure 3:
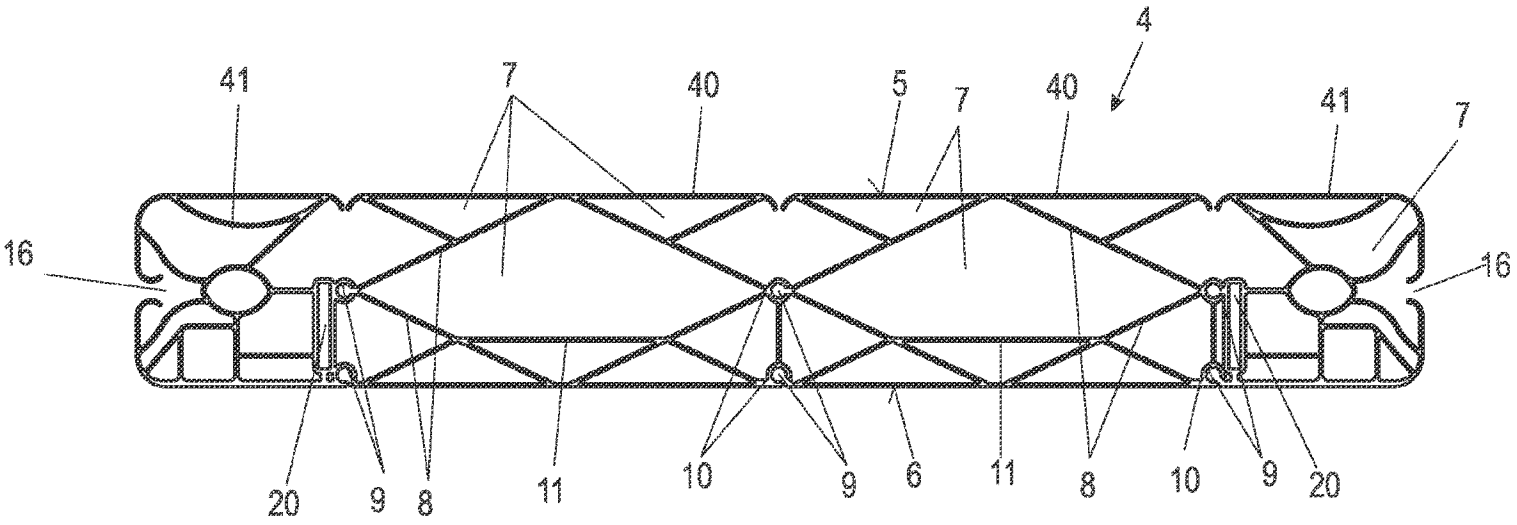
FIG. 3 shows a sectional view through the molded body of FIG. 2.

In FIG. 3, the molded body 4 is shown in section. The molded body 4 comprises a plurality of hollow chambers 7 surrounded by webs 8 of a stiffening structure. The webs 8 of the stiffening structure may be arranged in a truss-like manner to support the molded body 4, wherein the molded body 4 has a substantially smooth surface 5 and 6 on opposite skies respectively. The surfaces 5 and 6 are supported by the stiffening structure formed by webs 8. The proportion of hollow chambers 7 relative to the total volume of the molded body 4 is more than 50%, for example between 70% and 95%. In this respect, the molded body 4 can be produced with a large volume and a low dead weight. The molded body 4 or the individual parts 40, 41 and 42 of the molded body are thereby preferably produced by injection molding, extrusion or 3D printing.

Two pockets 20 are formed on the molded body 4, which have a cross-sectional geometry that corresponds substantially to the cross-sectional geometry of the lever 3. The lever 3 is of plate-shaped design, and the pockets 20 are correspondingly rectangular in cross-section. The lever 3 can be fixed by clamping or latching to the pockets 20 of the molded body 4, so that tool-free assembly is possible. Optionally, the lever 3 can also be glued or screwed to the molded body 4.

The lever 3 may also have a different geometry, for example it may be shaped as an L-shaped elbow, in which case the pocket 20 also has a corresponding geometry.

Each individual part 40 comprises connecting means 9 formed as thickened strips which can be fixed to retaining means 10 of an adjacent individual part 40, 41 or 42 by latching, static friction or insertion. The retaining means 10 are formed, for example, as a groove which embraces the connecting means 9. These connecting means 9 and retaining means 10 are provided both between the individual parts 40 and between the individual parts 41, wherein the individual parts 41 are arranged on the edge side. A groove 16 delimited by webs is formed on the end face of the individual parts 41, in which further components can be fixed, for example a seam of a flexible cover for the molded body 4. Slits are also formed between the individual parts 40 in the region of the surface 5. In addition, the slot-shaped grooves 16 serve to increase the mobility of the individual part 40.

The surfaces 5 and 6 have a different elasticity when a contact pressure is applied. This is due to the fact that the stiffening structure consisting of the webs 8 is formed differently in the area adjacent to the surface 5 than adjacent to the surface 6. An additional reinforcing web 11 is provided adjacent to the surface 6, which is missing adjacent to the surface 5, As a result, the surface 5 is more elastically formed than the surface 6 when a contact pressure is applied, which can be used, for example, to optimally adapt the spring properties at the surface 5 to the intended use.

Figure 4:
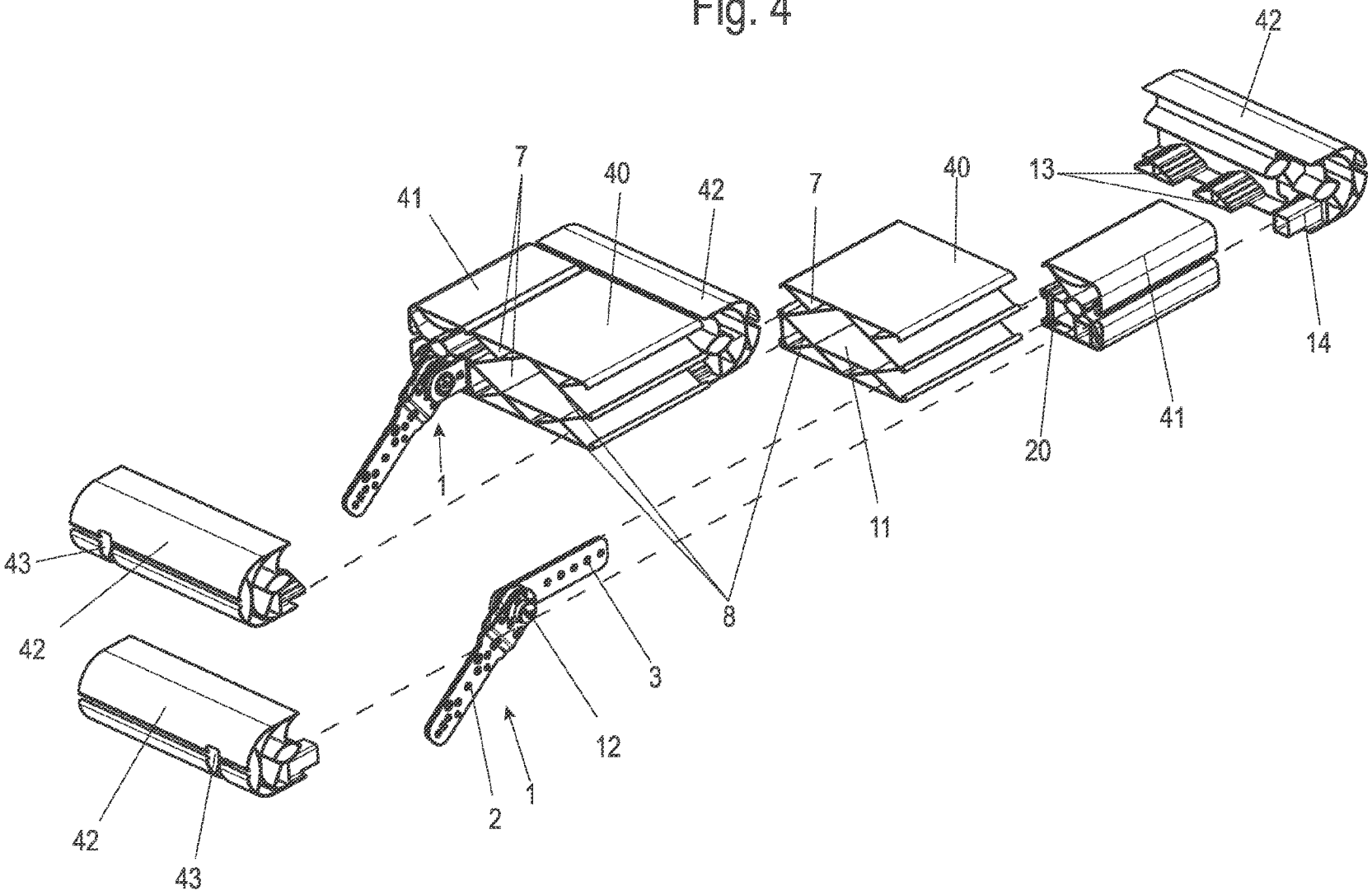
FIG. 4 shows a perspective exploded view of the movable furniture part of FIG. 2.

In FIG. 4, the molded body is shown in a view during assembly. The two pivot fittings 1 comprise the two levers 2 and 3, which are rotatably mounted about an axis 12 and can be fixed in different angular positions relative to each other, as disclosed in DE 10 2017 110 253 A1 and DE 10 2015 113 749 A1. The pivot fitting 1 shown in the exemplary embodiment is only shown by way of example. Other types of pivot fittings or pivot fittings with additional linear movement can also be used.

During assembly, the web-shaped lever 3 is inserted into a pocket 20 and fixed or pressed therein, with the pocket 20 being formed on the individual part 41 of the molded body 4, in the central region between the two edge-side individual parts 41, two central individual parts 40 are provided which can be fixed to one another by inserting the connecting means 9 on the retaining means 10. Depending on the application, the number of individual parts 40 in the central region can be varied in order to change the length of the molded body 4. On opposite sides, individual parts 42 are provided on the longitudinal edges of the molded body 4, which are arranged on the edge side. The two individual parts 42 on the side of the pivot fittings 1 comprise the slot 43 for passage of the ever 2 in the region of a rounded edge. The slot 43 or clearance is required to allow the pivot fitting 1 to pivot. The lever 2 needs clearance due to the pivoting, as this would otherwise strike the individual part 42.

On the opposite side, individual parts 42 are also provided, which are fixed to the individual parts 40 and 41 via plugs 13 and 14. The pings 13 and 14 have a cross-sectional contour which is adapted to the contour of hollow chambers 7 on the individual parts 40 and 41, so that the plugs 13 and 14 can be clamped to the individual parts 40 and 41. Optionally, the plugs 13 and 14 can also be glued or screwed to the individual parts 40 and 41.

Figure 5B:
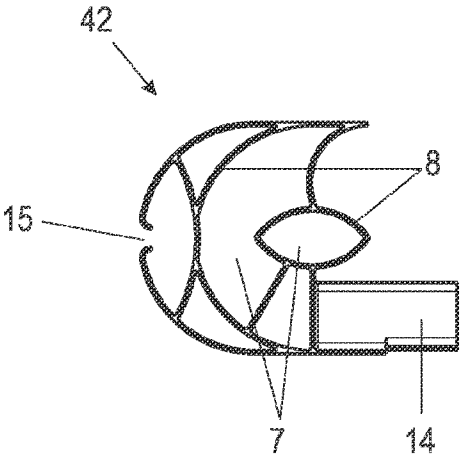
FIGS. 5A and 5B shows two detailed views of an individual part of the molded body.
Figure 5A:
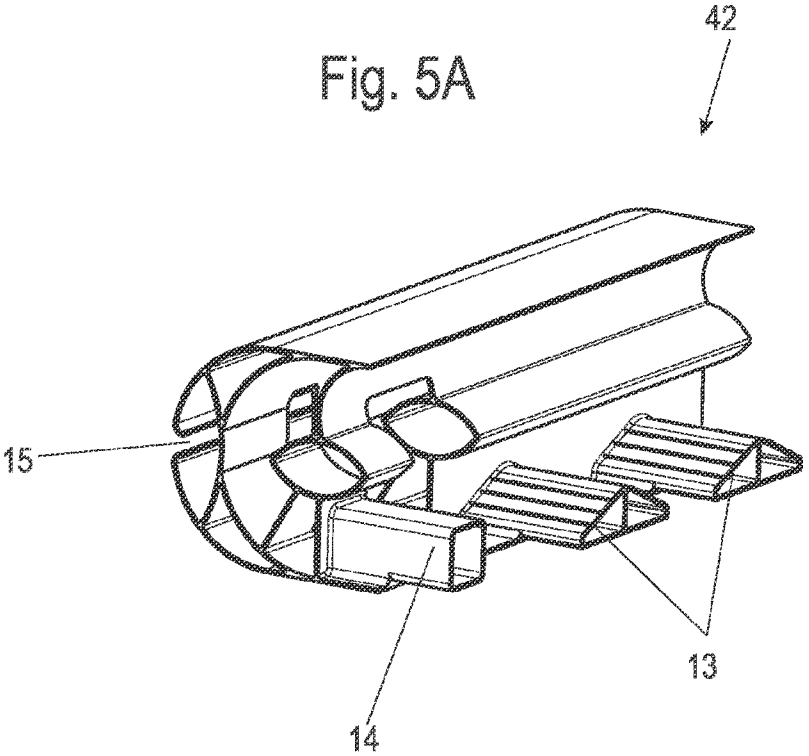

In FIGS. 5A and 5B, an individual part 42 of the molded body 4 arranged at the longitudinal edges is shown in detail, it can be seen that a slot-shaped receptacle 15 is formed on the rounded edge, into which a component can be inserted, for example a seam or a quick-hooking profile of a flexible cover surrounding the molded body 4. Furthermore, plugs 13 and 14 can be seen which are insertable into the hollow chambers on the individual parts 40 and 41.

In the illustrated exemplary embodiment, the molded body 4 is composed of eight individual parts 40, 41 and 42. The number of individual parts may of course be varied, depending on the size and shape of the molded body 4. In the illustrated exemplary embodiment, the molded body 4 is substantially plate-shaped with a flat smooth surface 5 on the upper side and a flat smooth surface 6 on the lower side. Other geometries of a molded body 4 can also be used, for example in a curved shape or in an angular shape.

Figure 6:
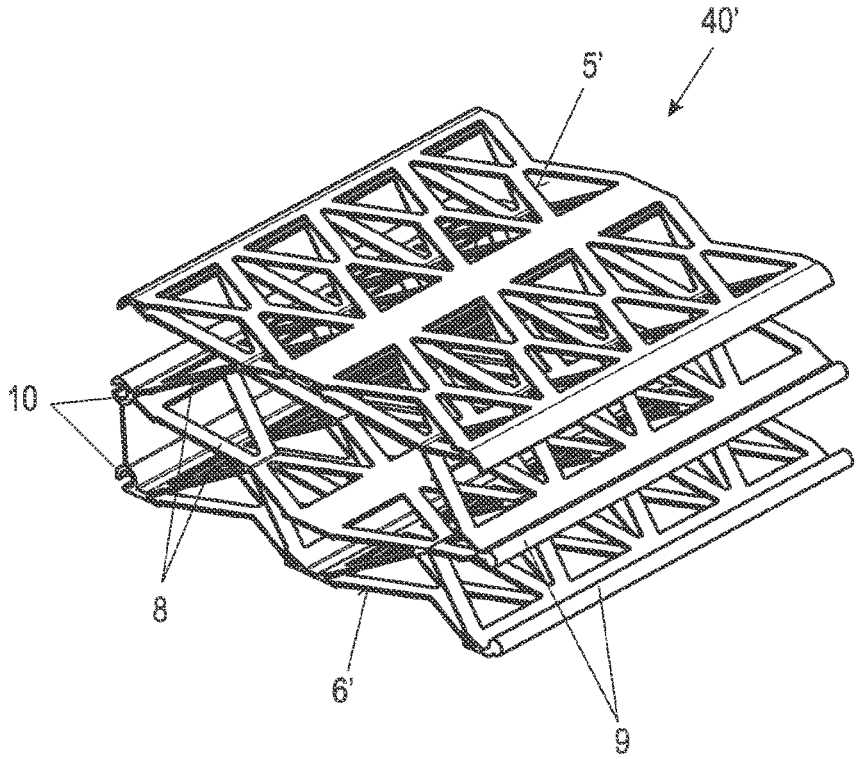
FIG. 6 shows a view of a modified individual part.

In FIG. 6, a modified individual part 40' for a molded body is shown. As in the previous exemplary embodiment, the single part 40' comprises connecting means 9 in the form of strips which can be fixed to U-shaped retaining means 10 of an adjacent single part 40', 40, 41 or 42. The surfaces 5' and 6' are not smooth but are formed in a lattice shape. They, can also have a different elasticity when a contact pressure is applied.

A molded body 4 according to the invention can also be used for an immovable furniture part, in particular a head part, an arm part or a back part. Due to the modular structure and the low weight, an optimized and individually designable seating furniture is created while at the same time improving the support properties. The otherwise rigid furniture parts can be connected to the base part by means of height-adjustable rods. In this case, the rods can be fixed in the molded body 4 without tools, analogously to the levers 3. The rods then form a connecting fitting.

In addition to head parts, arm parts and foot rests, a back part may also constitute a molded body 4 according to the invention or a movable furniture part according to the invention.

The levers 2 and 3 can also perform a combined rotary and sliding movement instead of a pure rotary movement about an axis. Furthermore, the levers can also be arranged to pivot relative to each other via a multi-joint mechanism.

The molded body may also be filled in the region of the cavities. Furthermore, the molded body may comprise a body having an air-filled film or a film having fabric remnants as a flexible structure.

When the parts of the molded body are 3D printed, the surfaces can be latticed or have a honeycomb structure to achieve weight savings as well as even better spring properties.

LIST OF REFERENCE SIGNS

1 Pivot fitting
2 Lever
3 Lever
4 Molded body
5, 5' Surface
6, 6' Surface
7 Hollow chamber
8 Web
9 Connecting means
10 Retaining means
11 Reinforcing web
12 Axis
13 Pug
14 Plug
15 Receptacle
16 Groove
20 Pocket
40, 40' Individual part
41 Individual part
42 Individual part
43 Slot
100 Piece of furniture
101 Furniture part
102 Furniture part
103 Furniture part
104 Base part

What is claimed is:

1. A piece of furniture (100) comprising a base part (104) on which a movable furniture part (101, 102, 103) is pivotably mounted via at least one pivot fitting (1), wherein the at least one pivot fitting (1) is fixed to the base part (104) by means of a first lever (2) and is fixed to the movable furniture part (101, 102, 103) by means of a second lever (3) which is arranged pivotably with respect to the first lever (2), wherein the second lever (3) is fixed to a molded body (4) which is provided with a plurality of hollow chambers (7) and which forms a core of the movable furniture part (101, 102, 103), wherein a pocket (20) for accommodating at least part of the second lever (3) is formed in the molded body (4), and wherein the second lever (3) is fixed in the pocket (20) in a clamping and/or latching manner.

2. The piece of furniture according to claim 1, wherein a stiffening structure formed by webs (8) is formed in the molded body (4) and the hollow chambers (7) are arranged between the webs (8).

3. The piece of furniture according to claim 1, wherein the molded body (4) is designed substantially plate-shaped and is composed of a plurality of individual parts (40, 41, 42).

4. A piece of furniture (100) comprising a base part (104) on which a movable furniture part (101, 102, 103) is pivotably mounted via at least one pivot fitting (1), wherein the at least one pivot fitting (1) is fixed to the base part (104) by means of a first lever (2) and is fixed to the movable furniture part (101, 102, 103) by means of a second lever (3) which is arranged pivotably with respect to the first lever (2), wherein the second lever (3) is fixed to a molded body (4) which is provided with a plurality of hollow chambers (7) and which forms a core of the movable furniture part (101, 102, 103), wherein a slot (43) is formed on the molded body (4) through which the first lever (2) is passed.

5. A piece of furniture (100) comprising a base part (104) on which a movable furniture part (101, 102, 103) is pivotably mounted via at least one pivot fitting (1), wherein the at least one pivot fitting (1) is fixed to the base part (104) by means of a first lever (2) and is fixed to the movable furniture part (101, 102, 103) by means of a second lever (3) which is arranged pivotably with respect to the first lever (2), wherein the second lever (3) is fixed to a molded body (4) which is provided with a plurality of hollow chambers (7) and which forms a core of the movable furniture part (101, 102, 103), wherein the molded body (4) has a substantially smooth or lattice-shaped surface (5, 6, 5', 6') on two opposite sides and wherein the two surfaces (5, 6, 5', 6') have a different elasticity due to the shaping of the molded body (4).

6. The piece of furniture according to claim 1, wherein the molded body (4) or the individual parts (40, 41, 42) of the molded body (4) are produced by injection molding, extrusion or 3D printing.

7. The piece of furniture according to claim 1, wherein the proportion of hollow chambers (7) in the molded body (4) in relation to the total volume is over 50%.

8. The piece e of furniture according to claim 1, wherein the molded body (4) is surrounded on its outside by a flexible cover.

9. The piece of furniture according to claim 1, wherein the movable furniture part (101, 102, 103) is pivotably mounted on the base part (104) via two or more pivot fittings (1).

10. The piece of furniture according to claim 1, wherein the movable furniture part (101, 102, 103) is designed as an armrest, footrest or headrest.

11. The piece of furniture according to claim 1, wherein the base part (104) is formed as a seat or back part of an upholstered piece of furniture or a vehicle seat.

* * * * *